US005463385A

United States Patent [19]

Tyburski

[11] Patent Number: 5,463,385

[45] **Date of Patent: * Oct. 31, 1995**

[54] ROADWAY SENSOR SYSTEMS

[75] Inventor: Robert M. Tyburski, Silver Spring, Md.

[73] Assignee: Mitron Systems Corporation, Columbia, Md.

[ * ] Notice: The portion of the term of this patent subsequent to Sep. 5, 2012, has been disclaimed.

[21] Appl. No.: 880,410

[22] Filed: May 8, 1992

Related U.S. Application Data

[63] Continuation-in-part of Ser. No. 406,345, Sep. 13, 1989, abandoned, which is a continuation-in-part of Ser. No. 346,685, May 3, 1989, abandoned.

[51] Int. Cl.[6] ..... G08G 1/01

[52] U.S. Cl. ..... 340/933; 200/86 A; 340/941

[58] Field of Search ..... 340/940, 941, 340/933, 666; 73/146; 174/105 SC, 106 SC, 97, 102 SP; 377/9; 200/86 A, 86 R; 404/6, 12, 71

[56] References Cited

U.S. PATENT DOCUMENTS

| | | | |
|---|---|---|---|
| 2,299,356 | 10/1942 | Strohm et al. | 174/97 |
| 4,374,299 | 2/1983 | Kincaid | 340/933 |
| 4,769,514 | 9/1988 | Uematsu et al. | 174/106 SC |
| 4,945,356 | 7/1990 | Henderson et al. | 340/941 |
| 5,008,666 | 4/1991 | Gebert et al. | 340/933 |

FOREIGN PATENT DOCUMENTS

| | | | |
|---|---|---|---|
| 0287250 | 10/1988 | European Pat. Off. . | |
| 0387093 | 9/1990 | European Pat. Off. | 340/933 |
| 2123795 | 12/1971 | Germany | 340/941 |
| 0757357 | 9/1956 | United Kingdom | 174/97 |

*Primary Examiner*—Brent Swarthout
*Attorney, Agent, or Firm*—Jim Zegeer

[57] ABSTRACT

A linear roadway vehicle sensor for sensing vehicular traffic thereover includes a flexible carrier comprising an elongated flat elastomeric member having upper and lower surfaces and at least one groove in one of the surfaces. An elongated pressure sensor is carried in the one groove and a linear weight is distributed along and secured to the length of said flexible carrier. The weight has a weight per unit length which is sufficient to maintain said sensor on said roadway and substantially immune to lifting from the roadway because of air flow effects and turbulence caused by vehicles.

16 Claims, 3 Drawing Sheets

ROADWAY SENSOR SYSTEMS

REFERENCE TO RELATED APPLICATIONS

This application is a continuation-in-part of my application Ser. No. 406,345 filed Sep. 13, 1989 entitled "ROADWAY SENSORS AND METHOD OF INSTALLING SAME", now abandoned, which was, in turn, a continuation-in-part of my application Ser. No. 07/346,685 filed May 3, 1989 entitled "ROADWAY SENSORS AND METHOD", now abandoned, which are incorporated herein by reference.

BACKGROUND AND BRIEF DESCRIPTION OF THE INVENTION

In my above-identified application Ser. No. 406,345, I disclose roadway sensors in which a piezoelectric sensor is carried within an envelope and a linear weighting member is substantially coextensive with the sensor to maintain the sensor on the roadway despite being traversed by heavily loaded trailer trucks traveling at high speeds generating trailing air turbulences having the effect of sweeping the roadway. The weight member is uniformly distributed along the roadway portions of the sensor strip to maintain the sensor on the roadway and substantially immune to air effects generated by vehicular traffic on the roadway, such as a loaded truck trailer traveling at high speeds. Preferably the weight is a flat malleable metal such as a lead strip having a weight of about one pound per linear foot. For lower speeds and/or smaller or lighter vehicles (which cause less air flow effects) a lower distributed weight can be used, for example, one-half pound per linear foot of sensor.

Since the weight member, in a preferred embodiment, was a flat strip of lead, and since roadways are not flat, e.g., concrete roads wear and wide grooves develop over time and create a cavity or groove where the wheels travel, the malleable lead strip adapts to such cavities and undulations and curvatures in the roadway so that the sensor does not bounce and oscillate for a long period of time as would be the case if the sensor were mounted on a rigid member such as a steel strip. During the period of time when the strip is vibrating, the sensor output signal would mask legitimate pulses from a tire of a closely spaced axle, for example.

The sensor weighting system disclosed in my above-identified application monitors a variable number of lanes simultaneously, preferably from one to six lanes or more. In a worst case situation, six lanes, this would require 12 feet times 6 equals 72 feet, plus 8 feet for the shoulder or an 80 foot length. With a rigid steel base member, this would be difficult to install in the field. In my above-identified application, I teach that the sensor is maintained essentially motionless when a vehicle is traversing the sensor if the weight is added to avoid movement effects due to air flow generated by the moving vehicle. Large trucks with wide square backs are one of the worst. As discussed above, experience has demonstrated that a weight of one pound per foot is near ideal for traffic up to speeds of about 85 mph. In order to achieve this weight, a 2" wide piece of lead 3/32" thick is glued to a five ounce per foot elastomeric or rubber carrier. The completed assembly is approximately one pound per foot. In contrast, because the specific gravity of steel is approximately 7.89, and that of lead is 11.35, the steel would need to be thirty percent thicker than lead (0.093" vs. 0.121"). This thicker steel would make the handling of a long sensor very difficult and cause the strip to vibrate as discussed above and, therefore, an integral steel strip is not able to perform according to the invention.

The present invention adapts this distributed weight concept of my earlier above-identified applications and, in addition, provides a unique sensor carrier which is both coilable and reusable and adaptable to wide varieties of roadway conditions and is easily adaptable to multiple roadways.

According to one embodiment of the invention, a carrier made an extruded or molded roadway rubber (such as Neoprene, etc.) is provided with one or more sensor carrying grooves and, depending on the number of lanes of roadway traffic to be sensed, a plurality of parallel signal conductor carrying grooves. In a preferred embodiment, the sensor carrier has an upper surface which is ramped and a lower surface in which are formed the sensor receiving grooves and the signal conductor receiving grooves. As will be shown later herein, the sensor and conductor receiving grooves may be identical. A flat weight member is secured to the lower surface of the carrier, preferably by an adhesive. An important feature of this assembly is that it is able to adapt to curvature and undulations in the roadway in such a way as to eliminate or minimize extraneous signals caused by the sensor being bounced up and down on the roadway by traffic and/or by aerodynamic effects caused by high speed heavy vehicular traffic thereover.

The carrier/sensor of the present invention has the following benefits over road tubes and other prior art systems:

(a) Conforms to and hugs roadway;

(b) Simultaneous multiple individual lane sensing;

(c) Adjustable, ideal for driveway and turning movement studies;

(d) Excellent for speed, volume and classification sensing;

(e) Eliminates the need for a mechanical air switch;

(f) Eliminates recording failures due to pin hole air leaks in road tube;

(g) Eliminates recording failures due to water in the road tube;

(h) Eliminates recording failures due to nails coming loose due to high tension stretch on the road tube;

(i) Greater accuracy;

(j) Safe, quick installation;

(k) Rugged, long lasting and reusable.

Traffic engineers throughout the world have been seriously hampered in the efforts to perform volume, speed and classification studies when road tubes are utilized for input to their traffic recorders. The piezoelectric sensor method described in this application offers the traffic engineer a means of generating electrical impulses when the vehicle's axle traverses the sensor assembly. This invention provides the traffic engineer volume, speed and classification data which would be virtually impossible to record with existing road tubes. Using this method also enables the traffic engineer to field install the piezoelectric sensor assembly in inclement weather on the roadway and to adjust its active detection area to the requirements of the data capture application.

DESCRIPTION OF THE DRAWINGS

The above and other objects, advantages and features of the invention will become more apparent when considered with the following specification and accompanying drawings wherein.

DETAILED DESCRIPTION OF THE INVENTION

Figure 1A:
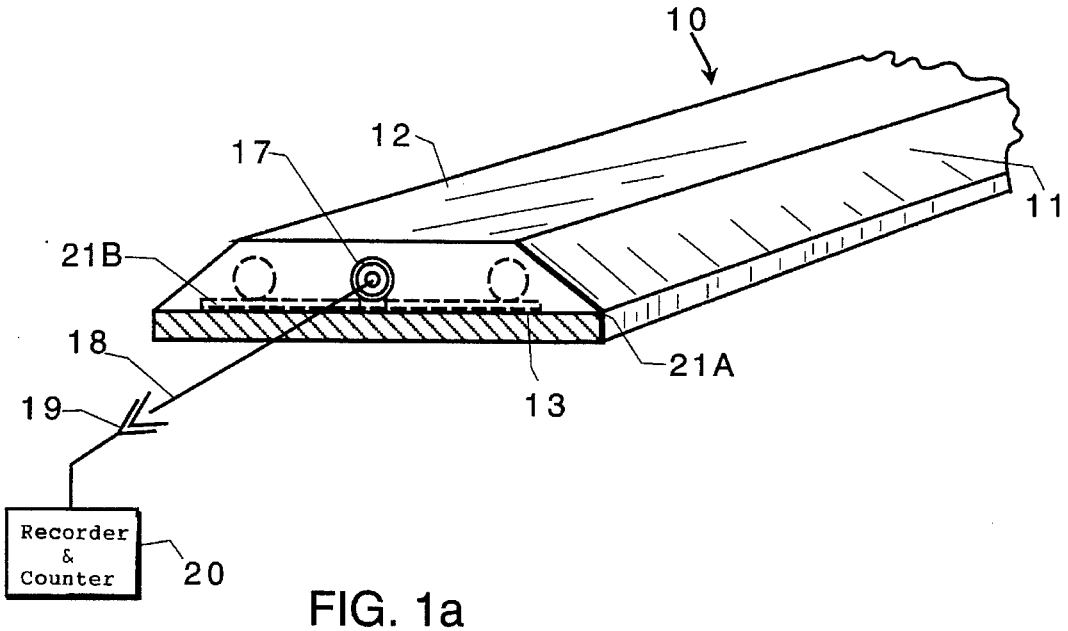
FIG. 1*a* is a sectional and isometric view of a roadway sensor incorporating the invention.

A basic construction incorporating the invention is illustrated in FIG. 1*a* wherein a roadway sensor assembly 10 is comprised of an extruded flat elastomeric carrier 11 having an upper surface 12 which may be ramped to better accommodate tire forces and a flat planar lower surface 13. Lower surface 13 in the preferred embodiment is provided with sensor groove 14 which has a narrow mouth 15 and an enlarged sensor carrying portion 16. Mouth 15 has sidewalls which can be spread apart sufficiently to allow the sensor cable to be snugly seated in the enlarged base 16 and then spring back to retention position. A piezoelectric sensor cable assembly 17 is carried in sensor groove 14. Piezoelectric sensing cable assembly 17 can be of the type manufactured by Atochem Corporation of Norristown, Pa. In such cables, a piezoelectric plastic such as KYNAR™, is provided with sensing electrodes (not shown) which are connected to a flexible coaxial cable 18, which can be encased in a protective envelope. While in the preferred embodiment the piezoelectric sensing cable is round, as shown in other embodiments, the sensor can be flat or oval shaped.

The coaxial cable 18 has a conventional signal cable connector 19 for secure electrical connection or coupling of analog signals generated by vehicular traffic to recorder and counter circuit 20 of the type disclosed in U.S. Pat. No. 4,258,430 for example, owned by the assignee hereof.

The carrier 11 with piezoelectric sensor cable assembly 17 installed and snugly seated in groove portion 16 has a linear weight 21 secured, preferably by a flexible adhesive 21A, to the lower surface 13 of flat carrier 11. Weight 21 can be of a type disclosed in my above-identified application, and preferably is a flat malleable metal strip made of lead, for example. The weight and the carrier have a weight per unit length of at least about one pound per foot for heavily traveled high speed highways. For three twelve foot roadways, this amounts to about 36 pounds. For lower speed roadway uses, the weight can be less as disclosed in my above-identified application.

Figure 1B:
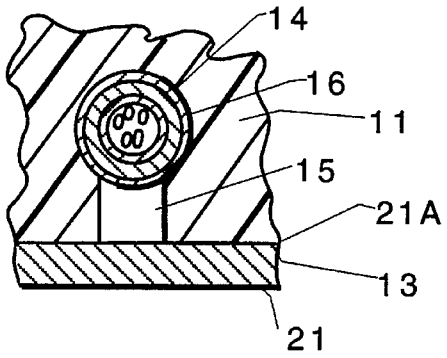
FIG. 1*b* is an enlarged view of a sensor carrying groove portion of FIG. 1*a*.
Figure 1C:
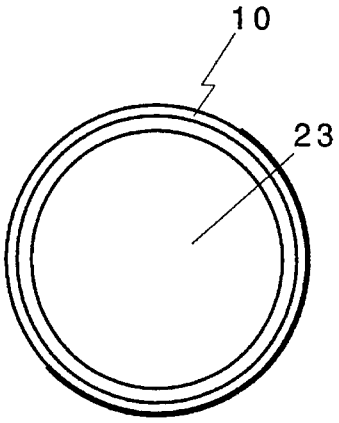
FIG. 1*c* shows the assembly of FIG. 1*a*, coiled on a form for transportation.

As shown in FIG. 1*c*, the sensor assembly 10 is coilable on a form 23 so that it can be easily unrolled upon a roadway. The weight will cause the sensor assembly to hug the roadway and because the lead is malleable, roadway traffic will cause the assembly to closely conform to the roadway surface including roadway undulations.

Figure 2:
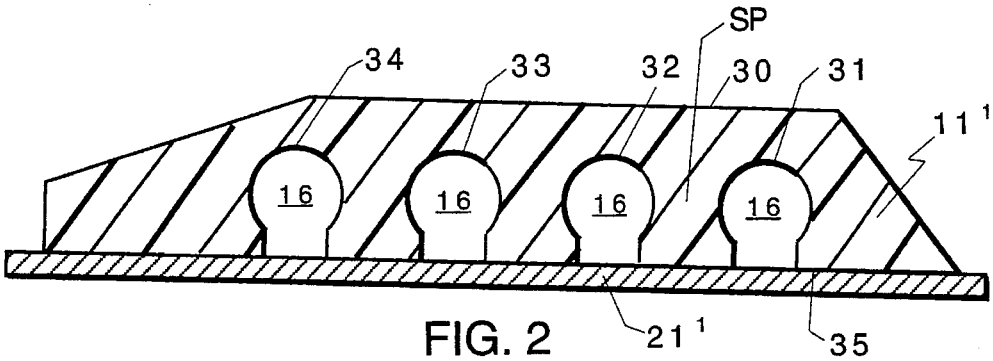
FIG. 2 is a further embodiment of a preferred embodiment of the invention.

As shown in FIG. 2, the flat carrier 30 has a plurality of grooves 31, 32, 33, 34 in its lower surface 35. This preferred embodiment is applicable to sensing vehicle traffic in multiple lanes of a roadway. In this case, a separate piezoelectric sensor cable is provided, one positioned in the carrier 11 to be in each roadway when the roadway sensor assembly 10 is uncoiled upon the roadway. In this embodiment, a sensor cable can be positioned either in its own groove and the coaxial cable for each sensor extending along the groove to a recorder and/or counter device 20 or, all of the sensors can be aligned in a common groove. In this latter case, a portion of the elastomeric material SP between the groove carrying the sensors and the groove designated to carry the coaxial cable for that sensor cable to the roadside for connection and attachment to counter device 20 can be snipped out. For example, if all of the sensors are carried in groove 31, the sensor in lane #1 adjacent the roadside would have its shorter coaxial cable directly connected to recorder/counter device 20. The next sensor (for roadway lane #2 for example) would have a short portion SP of the elastomeric barrier material between groove 31 and 32 cut or snipped out and the coaxial cable for that sensor pass through the cut out or snipped out portion and inserted in groove 32 and that coaxial cable extended in groove 32 to the roadside where its connector could be connected to recorder/counter 20. The same procedure would be carried out for the remaining sensor cables, using the next available groove, and so on. Thus, the carrier of FIG. 2 is very adaptable to accommodate a multiple lane roadway having up to four lanes.

Figure 3:
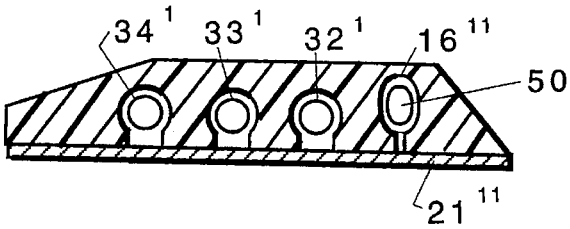
FIGS. 3–11 are illustrations of further embodiments of the invention.
Figure 4:
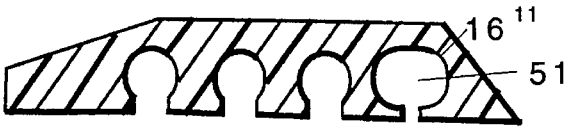

In the embodiment shown in FIG. 3, the sensor receiving portion 16', the sensor receiving groove 14' is oblong or oval-shaped to receive a flat or oval-shaped piezoelectric sensor cable 50 (also made by the Atochem Corporation) and maintain the sensor in a vertical orientation. By virtue of this vertical orientation, the electrical signals generated by the piezoelectric sensor is negative and an invertor circuit (not shown) can be used to invert the signal for use by the recorder/counter circuits. In the embodiment shown in FIG. 4, the sensor groove 51 is oval or oblong to accommodate a flat piezoelectric sensor cable of the type referred to above.

Figure 6:
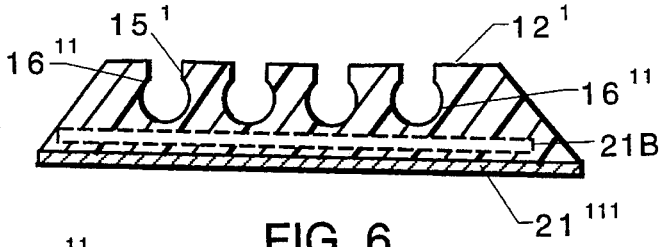
Figure 7:
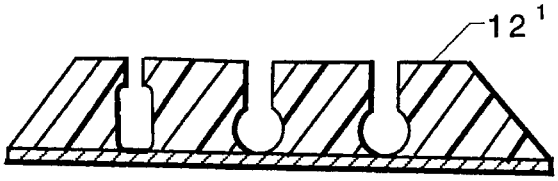
Figure 5:
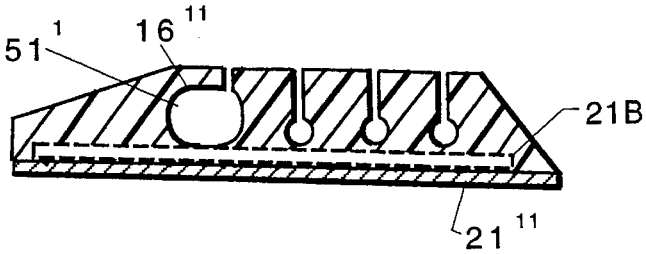

In the embodiments shown in FIGS. 6 and 7, the grooves for receiving the piezoelectric sensor cable assemblies and coaxial cables are in the upper surface 12' of the elastomeric carrier 11 and the weight 21 is adhesively secured to the lower surface 13 of the carrier. While this is a less preferred embodiment, it does lend itself to easy repair and/or replacement of the piezoelectric cable assemblies.

While I have illustrated the various preferred embodiments as having a piezoelectric carrier with lipped grooves for ease of assembly, sensors for different roadway lanes, and for ease of repair, it will be appreciated that the flat carrier can be extruded without grooves and one or more sensor cable assemblies encased during extrusion of the carrier and that assembly secured to the weight as disclosed in my above-referenced application; FIG. 1 shows two spaced sensor assemblies which can be used for speed measurements since the distance between the two sensors is rigidly fixed and the times of occurrence of the pulses used to determine vehicle speed. See Dixon application Ser. No. 07/904,623, filed concurrently herewith.

Figure 8:
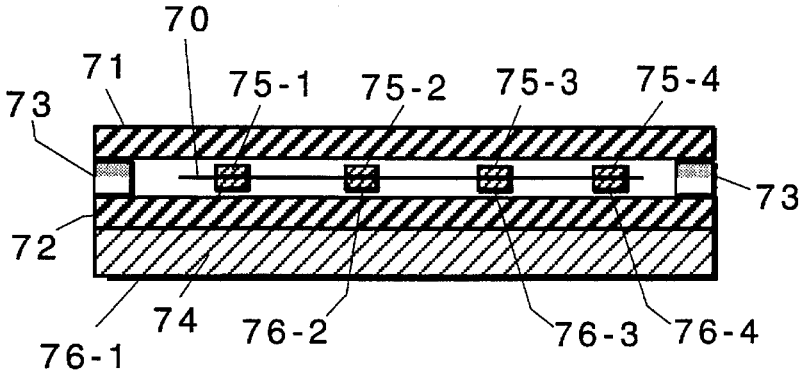
Figure 9:
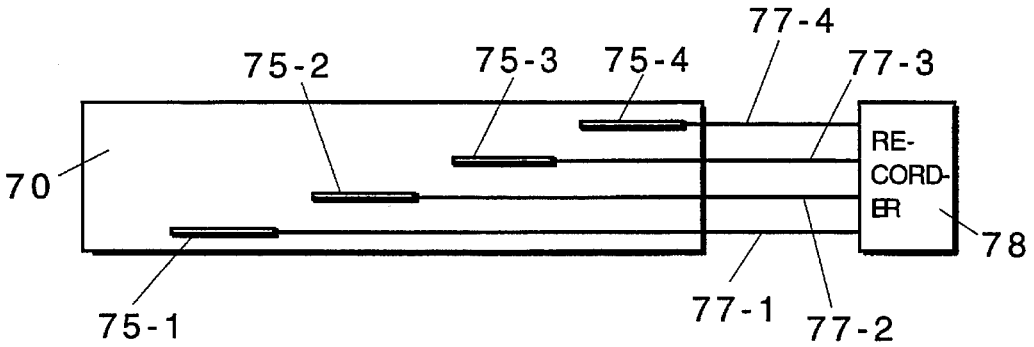

In the embodiment shown in FIGS. 8 and 9, a piezoelectric film strip 70 is sandwiched between a pair of roadway rubber laminate sheets 71 and 72 which are secured by an adhesive 73 to constitute the carrier. Lead weight 74 causes the sensor to hug the roadway and conform to undulations therein. In this case, the piezoelectric film strip 70 is wide and has lane electrodes 75-1, 75-2, 75-3, 75-4 on one surface. A separate electrode 76-1, 76-2, 76-3 and 76-4 may be provided or a common electrode may be applied to the lower surface of the film strip 70. These sensing electrodes can be connected to coaxial cables 77-1, 77-2, 77-3, 77-4 which, in turn, is connected to a recorder 78.

Figure 10:
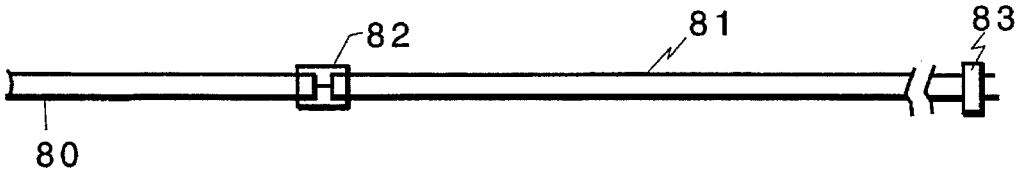
Figure 11:
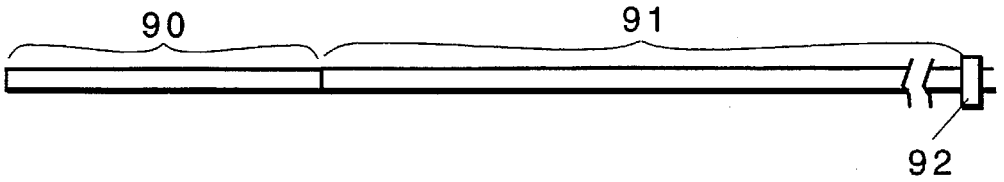

In FIG. 10, a coaxial sensor cable 80 is connected to coaxial cable 81 by a discrete connector 82 and cable 81 may be connected to a recorder or a connector 82. In FIG. 11, an active length or area of a piezoelectric sensor cable includes a polarized or paled portion 90 which has piezoelectric properties and a non-active area or portion 91. This construction avoids the use of a discrete connector such as connector 82.

While preferred embodiments of the invention have been shown and described, it will be appreciated that various modifications and adaptations of the invention will be obvious to those skilled in the art and it is intended that the claims encompass such modifications and adaptations.

What is claimed is:

1. In a linear roadway vehicle sensor for sensing vehicular traffic thereover, the improvement comprising, a weighted flexible carrier member comprising an elongated flat elastomeric member having upper and lower surfaces and at least one groove in one of said surfaces, an elongated pressure sensor carried in said at least one groove, a weight recess formed in said flexible carrier member and a linear lead weight means secured within said weight recess distributed along the length of said flexible carrier and means securing said flexible carrier to said linear lead weight means, said linear lead weight means being in situ malleable by roadway traffic to conform to the roadway surface including undulations therein, said linear lead weight means having a weight per unit length which is sufficient to cause said sensor to hug the roadway and maintain said sensor on said roadway and be substantially immune to lifting from the roadway because of air flow effects and turbulence caused by vehicles.

2. The invention defined in claim 1 wherein said at least one groove and weight recess are formed in said lower surface of said flat elastomeric member and said linear lead weight means is secured to said lower surface.

3. The invention defined in claim 1 wherein said linear roadway vehicle sensor has a length sufficient to sense multiple lanes of roadway traffic and said flexible carrier member, and said linear lead weight means is of corresponding length.

4. In a linear roadway vehicle sensor for sensing vehicular traffic thereover, the improvement comprising, a flexible carrier member comprising an elongated flat elastomeric member having upper and lower surfaces and at least one groove in one of said surfaces, an elongated pressure sensor carried in said at least one groove, linear weight means distributed along the length of said flexible carrier and means securing said flexible carrier to said linear weight means, said weight means having a weight per unit length which is sufficient to maintain said sensor on said roadway and substantially immune to lifting from the roadway because of air flow effects and turbulence caused by vehicles, said linear roadway vehicle sensor having a length sufficient to sense multiple lanes of roadway traffic and said flexible carrier member, and said linear weight means is of corresponding length, and wherein there are a plurality of grooves in said elastomeric member, and said pressure sensor includes piezoelectric cable means, one for each roadway, and all of said sensors being carried in a common groove, and at least one of said piezoelectric cable means has a shielded conductor carried to a side of the roadway in another of said grooves.

5. A linear roadway sensor for sensing vehicular traffic and a carrier for said sensor which is substantially immune to lifting from the roadway because of air flow turbulence caused by vehicles traveling at high speeds thereover, said carrier being a flat flexible elastomeric carrier member, having upper and lower surfaces, and a groove and weight recess in one of said surfaces for receiving said linear roadway sensor, and a linear malleable lead weight distributed along said flexible carrier member and secured within said weight recess, said linear malleable lead weight having a weight at least sufficient to render said flexible carrier member substantially immune to air effects generated by vehicular traffic on the roadway, and malleable by roadway traffic to cause said flexible carrier to conform to and hug the roadway surface and not be dangerous to moving traffic or pedestrians even if snagged or broken by vehicular traffic.

6. The invention defined in claim 5 wherein said flexible elastomeric carrier has a plurality of grooves in said one surface, and there are a plurality of said sensors, each sensor being constituted by a piezoelectric cable carried in one of said grooves.

7. The invention defined in claim 5 wherein said linear weight and said carrier have a weight per unit length of at least one pound per foot.

8. The invention defined in claim 7 wherein said linear weight is a flat lead strip.

9. In a linear roadway vehicle sensor having an electric pressure sensing cable for sensing vehicular traffic thereover, the improvement comprising, a flexible flat elastomeric carrier member having upper and lower surfaces and one or more linear grooves in one of said surfaces, a weight recess and a linear lead weight means carried and secured within said weight recess and distributed along the length of said elastomeric carrier member and means for securing said electric sensing cable in one of said grooves, said linear lead weight means being in situ malleable by roadway traffic to conform to the roadway surface including roadway undulations and having a weight per unit length which is sufficient to cause said sensor to hug the roadway and maintain said sensor on said roadway and be substantially immune to lifting from the roadway because of air flow effects and turbulence caused by vehicles.

10. The invention defined in claim 9 wherein said linear roadway vehicle sensor has a length sufficient to cross multiple lanes of roadway traffic and said flexible carrier member and said linear weight means are of corresponding length, there being a plurality of said linear grooves, a piezoelectric sensing cable for each roadway, respectively, with all of said piezoelectric sensing cables being carried in a groove, respectively.

11. A roadway sensor for sensing vehicular traffic and a carrier for said sensor which is substantially immune to lifting from the roadway because of air flow turbulence caused by vehicles traveling at high speeds thereover, said carrier being a flexible carrier member for said linear roadway sensor and having at least one groove therein, said groove having an enlarged base for receiving said sensor and a pair of sidewalls which are spreadable apart sufficiently to allow said sensor to be snugly seated in said enlarged base, said flexible carrier member includes a weight recess and linear lead weight distributed and secured within said weight recess along said flexible carrier member, said linear lead weight being in situ malleable on the roadway by vehicular traffic to conform to the roadway surface including undulations therein, and having a weight at least sufficient to render said flexible carrier member substantially immune to air effects generated by vehicular traffic on the roadway, and to cause said flexible carrier member to hug the roadway surface and not be dangerous to moving traffic or pedestrians even if snagged or broken by vehicular traffic.

12. The invention defined in claim 11 wherein said carrier is an extruded, flat elastomeric member having upper and lower surfaces, said at least one groove being formed in said lower surface and said linear lead weight being a flat strip of lead.

13. The invention defined in claim 11 wherein said carrier is a flat elastomeric extrusion having upper and lower surfaces, a plurality of said grooves in one of said surfaces, and a plurality of said sensors carried by at least one of said grooves, said linear lead weight being a flat lead strip, and means for securing said lower surface to said flat lead strip.

14. The invention defined in claim 13 wherein the surface having said grooves is said lower surface and said flat lead strip is adhesively secured to said lower surface.

15. The invention defined in claim 13 wherein said sensor is an electric sensor cable.

16. The invention defined in claim 15 wherein said grooves are a predetermined distance apart and there is at least two electric sensor cables, each in its own respective groove.

* * * * *